United States Patent [19]

Fukagawa et al.

[11] 4,069,789

[45] Jan. 24, 1978

[54] WATER APPLICATOR FOR WETTABLE TAPE

[75] Inventors: Susumu Fukagawa, Tama; Hisashi Sasaki, Tokyo, both of Japan

[73] Assignee: Asahi Kakoushi Kabushiki Kaisha et al, Osaka and Saitama, Japan

[21] Appl. No.: 680,172

[22] Filed: Apr. 26, 1976

[30] Foreign Application Priority Data

| | | |
|---|---|---|
| Feb. 14, 1976 | Japan | 51-15125 |
| Aug. 14, 1975 | Japan | 50-111501 |
| Oct. 4, 1975 | Japan | 50-40079 |

[51] Int. Cl.[2] ..... B05C 1/06

[52] U.S. Cl. ..... 118/43; 118/264

[58] Field of Search ..... 118/268, 235, 264, 267, 118/266, 43; 222/187; 15/100; 427/429

[56] References Cited

U.S. PATENT DOCUMENTS

| | | | |
|---|---|---|---|
| 2,737,149 | 3/1956 | Collins, Jr. et al. | 118/43 |
| 2,890,676 | 6/1959 | Waldschmidt | 118/43 |
| 3,966,094 | 6/1976 | Sheppard | 118/267 X |

FOREIGN PATENT DOCUMENTS

| | | | |
|---|---|---|---|
| 816,667 | 10/1951 | Germany | 118/43 |
| 656,263 | 8/1951 | United Kingdom | 118/43 |

*Primary Examiner*—John P. McIntosh

*Attorney, Agent, or Firm*—Hubbard, Thurman, Turner, Tucker & Glaser

[57] ABSTRACT

A water applicator includes a closed water main reservoir connected to a holding member for supporting the core of a tape roll. An auxiliary water reservoir is disposed in an upper portion of the main water reservoir with a water absorbing member positioned in the auxiliary water reservoir to contact the tape as it is withdrawn from the holding member. A scraper is disposed on the holding member in front of the absorbing member to remove excess water from the tape to prevent the tape from dripping. The applicator is convenient to carry and free of dripping even when turned upside down.

9 Claims, 4 Drawing Figures

WATER APPLICATOR FOR WETTABLE TAPE

BACKGROUND OF THE INVENTION

Wettable tapes are widely used which comprise a tape having a dry layer of starch, glue, vinyl acetate or like adhesive. When such tape is used, water must be applied to the adhesive layer to restore the tackiness. For this purpose, a water applicator adapted for use on the desk is presently available which comprises a base made by casting, a tape support and a water reservoir mounted on the base, and a water absorbing member provided on the water reservoir to apply water to the tape when it is withdrawn in sliding contact with the absorbing member. However, it is very inefficient to carry an article to the position of the water applicator, or to cut off a length of tape by the applicator and then take that piece of tape to the place where the article is located, every time the tape is used. The applicator is not handy because it is heavy and inconvenient to carry to the place of use and the water will drip from the reservoir. Heretofore a portable water applicator having a water reservoir, an absorbing member, a cutter and a roll supporting body has been suggested in the Japanese published specification No. SHO.50-148431 which was laid open for public inspection in Japan on Nov. 28, 1975. Though the applicator is portable, the cutter is located behind the absorbing member, and tape must be manually pushed out using an opening behind the cutter so that the applicator is not easy to use.

SUMMARY OF THE INVENTION

An object of this invention is to provide a handy water applicator for a tape which will not drip even when turned upside down and which is lightweight and convenient to carry to the desired place for use.

Another object of this invention is to provide a water applicator for a tape comprising a closed main water reservoir, an auxiliary water reservoir communicating therewith and positioned under the path for the tape, and a water absorbing member provided in the auxiliary water reservoir so as to prevent water from dripping.

Another object of this invention is to provide a water applicator for a tape having, in addition to the water absorbing member, a scraper for removing excess water from the tape to prevent the tape from dripping.

Still another object of this invention is to provide a water applicator for a tape further including a tape holding cover pivotably mounted on the main body for ensuring passage of the tape in contact with and over the water absorbing member during use, the tape holding cover being upwardly openable so as to render the tape easy to pass through the applicator for the replacement of tape.

DESCRIPTION OF THE PREFERRED EMBODIMENT

Figure 3:
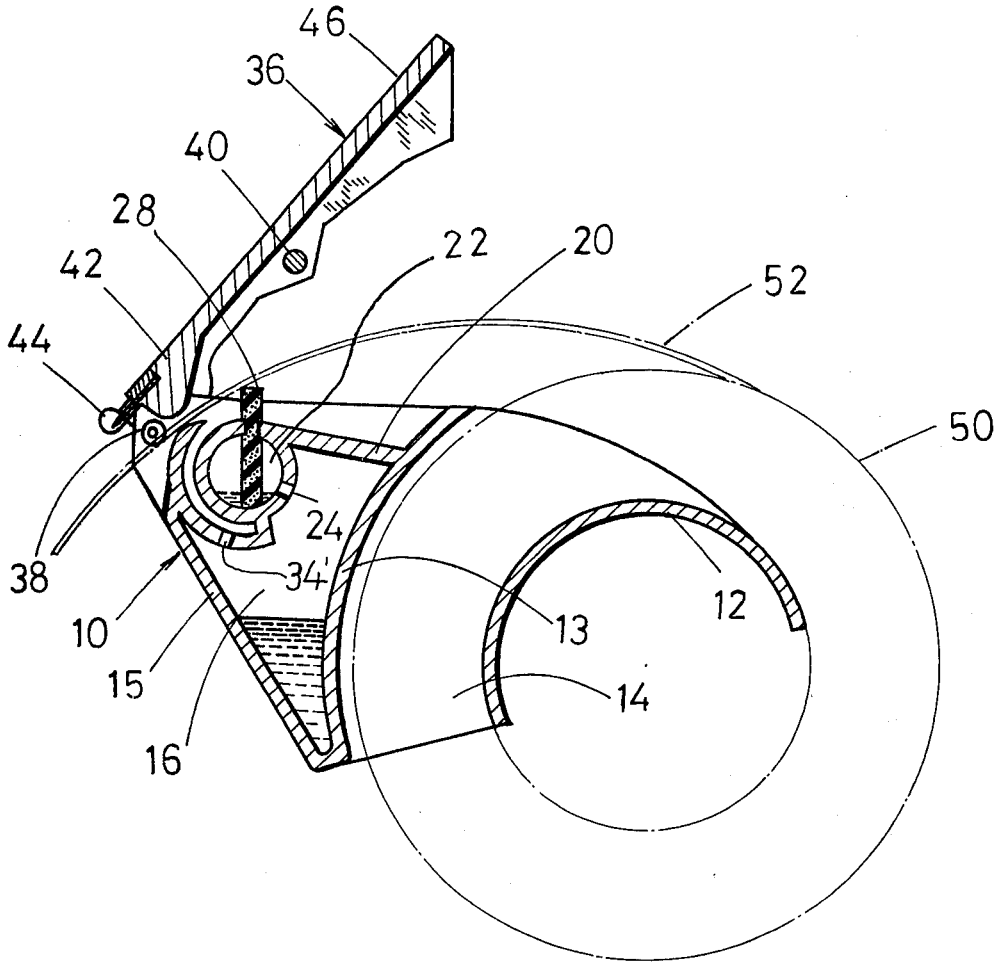
FIG. 3 is a sectional view showing the applicator of FIG. 2 with the holding cover open for the replacement of tape, and with an alternative bore between the auxiliary and the main water reservoirs

The water applicator has a main body 10 wholly formed from synthetic resin by injection molding and includes a semicircular ring 12 for supporting a tape. A connecting plate 14 projects from one side edge of the support ring 12 and is joined to a main water reservoir 16 composed of a rear wall 13 concentric with the support ring 12, a front wall 15, and opposite side walls. The main water reservoir 16 is liquid-tight and has a transparent water level window 18 in one side wall and a plugged water inlet (not shown) in the other side wall. Top wall 20 is integral with an auxiliary water reservoir 22. The auxiliary water reservoir 22 is formed in its lower portion with a port 24 communicating with the main reservoir 16 and has a slit-like opening 26 in the top wall. A water absorbing member 28 made of sponge, foamed synthetic resin or the like is inserted into the auxiliary water reservoir 22 through the opening 26, with its upper end projecting from the top wall 20 into the path for the tape. A scraper 30 extends from the bottom of the auxiliary water reservoir 22 in parallel to the front wall of the reservoir 22 and has a top end projecting into the path for the tape. A space between the scraper 30 and the auxiliary water reservoir 22 serves as a chamber 32 for reserving excess water. The excess water chamber 32 is in communication with the auxiliary water reservoir 22 through a small bore 34 formed in the front wall of the reservoir 22. Alternatively, as shown in FIG. 3, a bore 34' may be formed in the scraper 30 to maintain the chamber 32 in communication with the main water reservoir 16. Excess water is returned to the reservoir 22 or 16 through the bore 34. The opposite side walls of the main water reservoir 16 extend further forward beyond the scraper 30 to provide support for a pin 38 pivotably supporting the front end of a holding cover 36. The holding cover 36 comprises a top plate 46 having a width slightly greater than the width of tape and side plates extending from the opposite side edges of the top plate 46 at right angles to the top plate and abutting against protruding portions of the side walls of the main water reservoir 16. One of the side plates extends along the connecting plate 14 toward the support ring 12 to provide a locking portion 48 which detachably engages the edge of the support ring 12. The top plate 46 is provided at its front end with a serrated metal blade 44. On the rear side, the top plate 46 has a downward projection 42 positioned to the front of the water absorbing member 28 and carries a rotatable roller 40 disposed to the rear of the water absorbing member 28.

Figure 1:
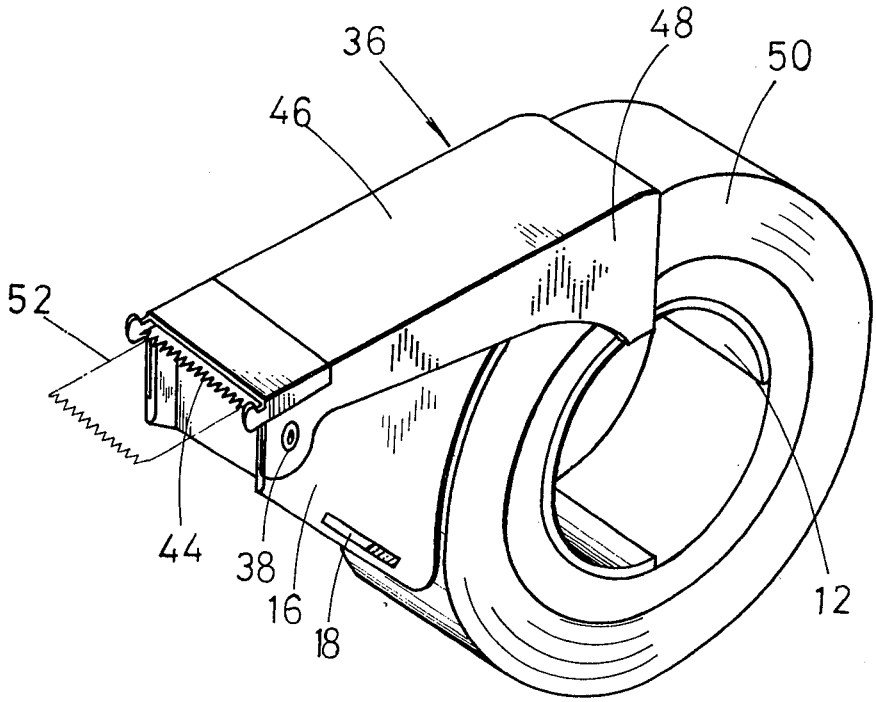
FIG. 1 is a perspective view showing a water applicator according to this invention.
Figure 2:
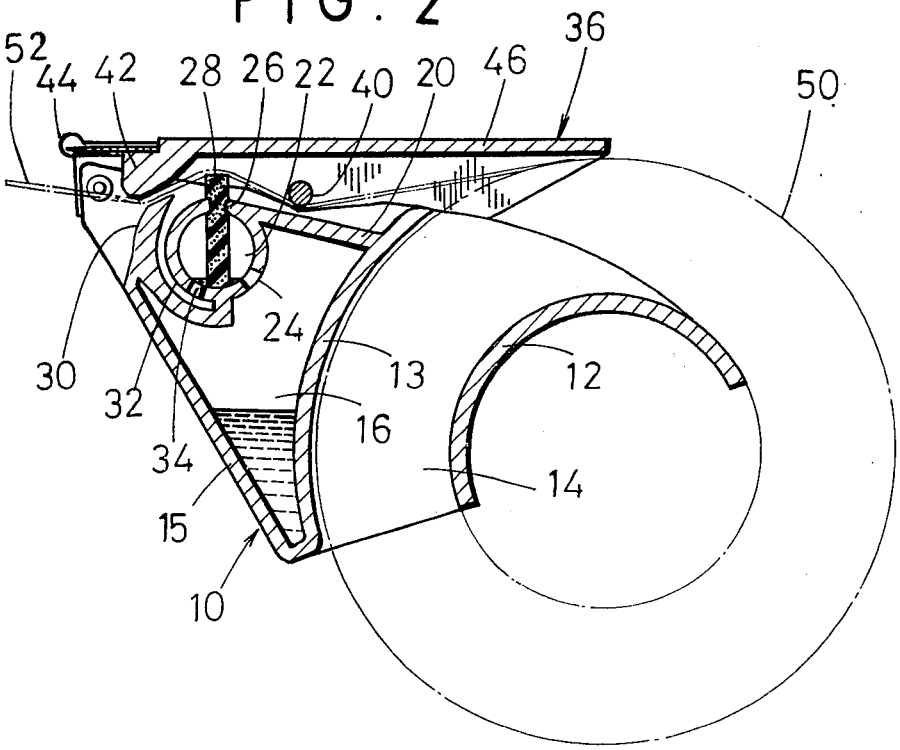
FIG. 2 is a view in vertical section of FIG. 1 showing the tape as it is withdrawn from the applicator.

As shown in FIG. 2, the tape 52 unwound from the tape roll 50 fitted around the support ring 12 is passed beneath the roller 40, over the water absorbing member 28 and a scraper 30, beneath the projection 42 and is then pulled out, always with water applied to the adhesive layer on the rear side of the tape by contact with the water absorbing member 28. For the replacement of tape, the locking portion 48 of the holding cover 36 is disengaged from the support ring 12 and raised away from the main body 10 as seen in FIG. 3. The leader end of a new roll of tape will then be easily passed through the applicator. The holding cover 36 is thereafter lowered to engage the end of the locking portion 48 with the edge of the support ring 12.

The water applicator described above is molded from synthetic resin and is therefore very lightweight and handy. When withdrawn, the tape is always wetted with water to restore its tackiness, since the adhesive layer thereon passes over the water absorbing member in contact therewith as illustrated in FIG. 2.

Excess water if applied to the tape, is scraped off the tape by the scraper 30 whose top end is always in contact with the rear side of the tape and is returned to the water chamber 32, from which the water flows back to the auxiliary water reservoir 22 or to the main water reservoir 16. Accordingly, unlike conventional devices, the present applicator keeps the tape free of dripping. When the applicator is turned upside down during use, the water in the main reservoir 16 will flow into and fill the auxiliary reservoir 22, but the absorbing member 28 closing the opening 26 prevents spilling of water heretofore experienced. The applicator is usable, free of trouble therefore.

Figure 4:
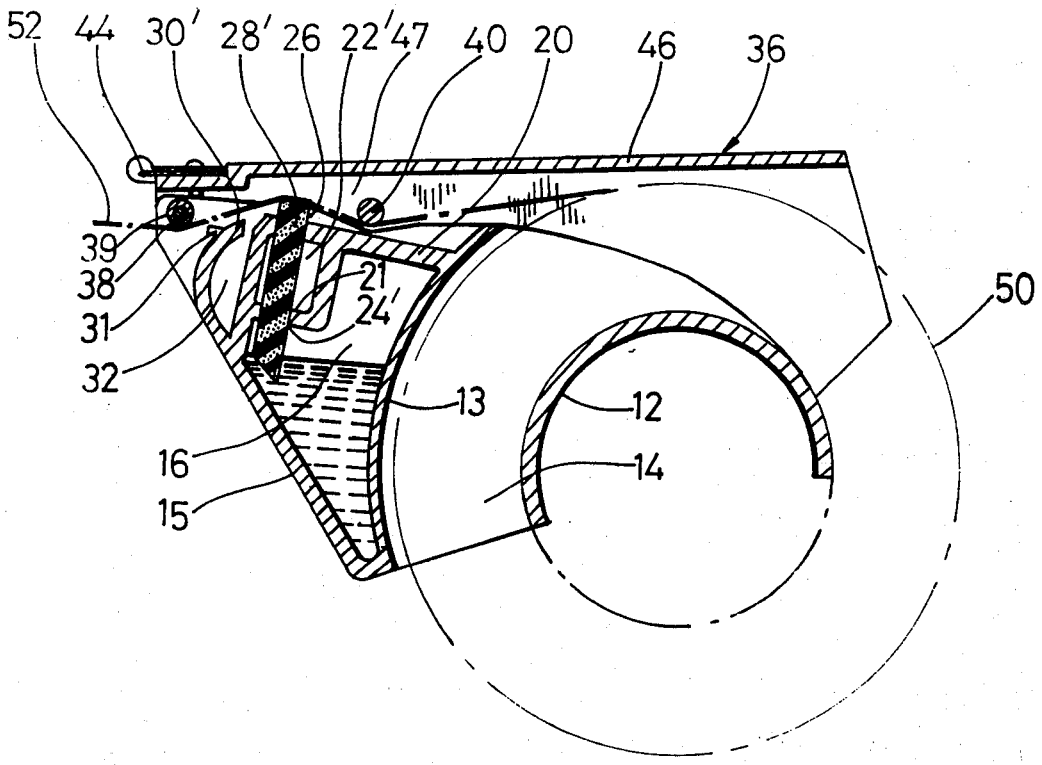
FIG. 4 is a view in vertical section of a water applicator showing another embodiment of this invention.

FIG. 4 illustrates another embodiment of this invention. Many of the elements and reference numerals in FIG. 4 correspond to those shown in FIG. 2 and need no further description. The water applicator in this modification has a long absorbing member 28' whose top portion projects into the path of tape through the opening 26, and lower portion of the member 28' extends through the bottom wall of an auxiliary water reservoir 22' through a port 24' projecting into the main reservoir 16. When the lower projecting portion of the absorbing member 28' is exposed to the water of the main reservoir 16, the absorbing member 28' swells and finally fills both openings 24' and 26 in the auxiliary water reservoir 22'. Thus, even when the water applicator is turned upside down or dropped to the floor, water does not spill from the reservoirs.

In this modification a rotatable roller 39 is provided under the cutting blade 44 to push the tape 52 onto absorbing member 28'. Scraper 30' is similar to scraper 30 but has a small projection 31 on its front surface to push tape 52 away from the front surface of scraper 30' and prevent the adhesive layer on the rear side of the tape from contacting the front of scraper 30'.

Other features of this invention will be apparent to those skilled in the art from the foregoing description and appended drawings. The specific embodiment described above can of course be modified to achieve the same object without departing from the spirit of this invention.

What is claimed is:

1. A water applicator for wetting adhesive tape including a tape support member for rotatably supporting a roll of the tape, a water absorbing member disposed to the front of the tape support member, and a cutting blade disposed adjacent the water absorbing member so that the tape is withdrawn in sliding contact with the top of the water absorbing member to apply water to the adhesive layer on the rear side of the tape, comprising:

a. an enclosed main water reservoir connected to the tape support member, b. an auxiliary water reservoir disposed in an upper portion of the main water reservoir and communicating with the main water reservoir, c. the water absorbing member having a lower portion inserted into the auxiliary water reservoir through an opening in the top wall of the auxiliary water reservoir and an upper portion extending into a path for the tape, d. a cover having a front end pivotably mounted on the front of the auxiliary water reservoir in front of the water absorbing member, and e. the cutting blade projecting from the front end of the holding cover in front of the water absorbing member.

2. A water applicator as defined in claim 1 wherein the main water reservoir has a transparent water level window.

3. A water applicator as defined in claim 1 wherein the cover has a side plate extending toward the tape support member to provide a locking portion detachably engageable with the tape support member.

4. A water applicator as defined in claim 1 wherein a lower portion of the absorbing member projects into the main water reservoir through an opening on the bottom wall of the auxiliary water reservoir.

5. A water applicator for wetting adhesive tape including a tape support member for rotatably supporting a roll of the tape, a water absorbing member disposed to the front of the tape support member, and a cutting blade disposed adjacent the water absorbing member so that the tape is withdrawn in sliding contact with the top of the water absorbing member to apply water to the adhesive layer on the rear side of the tape, comprising:

a. an enclosed main water reservoir connected to the tape support member, b. an auxiliary water reservoir disposed in an upper portion of the main water reservoir and communicating with the main water reservoir, c. the water absorbing member having a lower portion inserted into the auxiliary water reservoir through an opening in the top wall of the auxiliary water reservoir and an upper portion extending into a path for the tape, d. a cover having a front end pivotably supported on the front of the auxiliary water reservoir, e. a scraper for removing excess water mounted in front of the water absorbing member and extending into the path for the tape, and f. a chamber for reserving the excess water located between the scraper and the auxiliary water reservoir.

6. A water applicator as defined in claim 5 wherein the excess water chamber is in communication with the main water reservoir through a small bore in the scraper.

7. A water applicator as defined in claim 5 wherein the excess water chamber is in communication with the auxiliary water reservoir.

8. A water applicator as defined in claim 5 wherein a small projection is provided on a front surface of the scraper.

9. A water applicator for wetting adhesive tape including a tape support member for rotatably supporting a roll of the tape, a water absorbing member disposed to the front of the tape support member, and a cutting blade disposed adjacent the water absorbing member so that the tape is withdrawn in sliding contact with the top of the water absorbing member to apply water to the adhesive layer on the rear side of the tape, comprising:

a. an enclosed main water reservoir connected to the tape support member, b. an auxiliary water reservoir disposed in an upper portion of the main water reservoir and communicating with the main water reservoir, c. the water absorbing member having a lower portion inserted into the auxiliary water reservoir through an opening in the top wall of the auxiliary water reservoir and an upper portion extending into a path for the tape, and d. a cover having a front end pivotably supported on the front of the auxiliary water reservoir, said cover being provided on its underside with tape depressing means positioned to the front and rear of the water absorbing member to maintain the bottom surface of the tape in contact with the top of the water absorbing member.

* * * * *